US005386814A

United States Patent [19]

Denton

[11] Patent Number: 5,386,814

[45] Date of Patent: Feb. 7, 1995

[54] ADJUSTABLE ARROW REST ASSEMBLY

[76] Inventor: Don Denton, 37054 Ave. 17 1/2, Madera, Calif. 93638

[21] Appl. No.: 944,489

[22] Filed: Oct. 9, 1992

[51] Int. Cl.[6] ..... F41B 5/00

[52] U.S. Cl. ..... 124/44.5; 124/24.1

[58] Field of Search ..... 124/23.1, 24.1, 44.5, 124/88, 86

[56] References Cited

U.S. PATENT DOCUMENTS

| | | | |
|---|---|---|---|
| 4,236,497 | 12/1980 | Troncoso, Jr. | 124/24.1 |
| 4,299,195 | 10/1981 | Norris | 124/24 R |
| 4,344,409 | 8/1982 | Barner | 124/24 R |
| 4,492,214 | 1/1985 | Kielhoffer | 124/24 R |
| 4,664,093 | 5/1987 | Nunemaker | 124/24 R |
| 4,796,597 | 1/1989 | Farro | 124/44.5 |
| 4,838,237 | 6/1989 | Cliburn | 124/24 R |
| 4,890,596 | 1/1990 | Barlow | 124/44.5 |
| 5,052,364 | 10/1991 | Martin et al. | 124/24 R |
| 5,123,395 | 6/1992 | Saunders | 124/44.5 |
| 5,213,090 | 5/1993 | Tone | 124/24.1 X |

*Primary Examiner*—Randolph A. Reese
*Assistant Examiner*—Harry C. Kim

[57] ABSTRACT

An adjustable arrow rest assembly (18) for an archery bow to support an arrow shaft. The arrow rest assembly (18) comprises arrow rest (20), a mounting bracket (28A) and support arm (22). The support arm has a threaded aperture (23) on one end to secure the rest (20). The bracket (28A) has a slot (30A) to receive and adjust the support arm (22) laterally, vertically, and radially. The bracket (28A) is attached to the bow, to position the rest (20), to extend and pivot, from the bow arm side of the arrow.

20 Claims, 5 Drawing Sheets

ADJUSTABLE ARROW REST ASSEMBLY

BACKGROUND-FIELD OF INVENTION

This invention relates to archery. It is an arrow rest assembly used for launching an arrow from an archery bow.

BACKGROUND-DESCRIPTION OF PRIOR ART

Pro-shops and mail order houses supply consumers with many different models of arrow launchers and arrow rests.

The archery bow helped separate mankind physically from his prey and enemies about 12,000 years ago. Archery bows began to lose popularity after the invention of firearms. Firearms had more range, accuracy, and killing power. Firearm technologies became so advanced that hunting skill began to have little to do with hunting. Firearms took people away from the knowledge of nature, thus nature itself. The archery bow has increased in popularity lately for two reasons. The first reason is the arrival of the compound bow. The second is that guns are becoming the scapegoat for the exploding crime wave. The compound bow allows an archer to be able to shoot larger bows more accurately.

Originally arrows were shot by setting them on the archer's fist or a shelf. One development that creates interest is an arrow rest. The arrow rest is a device that mounts into a bowhandle sightwindow. The rest stabilizes the position of an arrow before and during the release of an arrow. Modern recurve and compound bows have a sight window cut-out extending past center. The arrow rest is located in the sight window.

In the 1950's a shoot around arrow rest was developed. U.S. Pat. No. 4,299,195 to Norris (1981) and U.S. Pat. No. 4,492,214 to Kielhoffer (1985) discloses the shoot around type arrow rest. The shoot around arrow rest extended and pivoted from the sightwindow sidewall side of an arrow. They extend from the side of the arrow, opposite bow hand. The bowhandle moves in the direction, of the attached bowhand. This movement occurs in the last portion of the arrow release. This movement transfers bowhandle movement to arrow. The shoot around arrow rest moves toward moving arrow in the last portion of the arrow release. The archer's paradox helps to prevent fletching contact.

A shoot through arrow rest developed later. U.S. Pat. No. 5,052,364 to Martin and Newbold (1991) discloses a shoot through type arrow rest. The shoot through arrow rest offered more space for arrow fletching to clear the arrow rest. The shoot through arrow rest was sometimes cushioned by a spring; or a plunger or arm backed by a spring. The shoot through arrow rest moves toward arrow, in the last portion of arrow release. This movement transfers bowhandle movement to arrow. They are expensive to manufacture.

About 1975, inventors developed a type of arrow rest called an "arrow launcher". Launchers were a shoot through arrow rest with arrow receiving points or fingers. The fingers held the arrow at the same position, on each side of the arrow. Prongs or metal plates that extended from the bow sidewall or bow rear below arrow, supported the arrow receiving points or fingers. U.S. Pat. No. 4,838,237 to Cliburn (1989) and U.S. Pat. No. 4,664,093 to Nunemaker (1987) discloses two of the launcher type arrow rests. These arrow rests apply about equal pressure to arrow sides during launch. The equal pressure transfers bowhandle movement to arrow. The rear connected prongs and plates are not connected above the pivot point of the bowhandle causing magnification of bowhandle movement. They are expensive to manufacture.

Other disadvantages of the above arrow rests and launcher are:

(a) The arrow stays in contact or near the launchers throughout launch or release. It is difficult if not impossible to stop contact between fletching and arrow rest.

(b) The arrow speed is decreased by friction throughout most of the launch or release.

(c) Part of the arrow rest is between some parts of the fletching and the sight window sidewall throughout release.

(d) They do not remove arrow rest resistance from the arrow's side opposite bow arm.

(e) They require a broadhead guard on rest or overdraw. The bowhandle movement causes more arrow rest contact with arrow. The contact makes practice, personal tuning, arrow size, arrow weight, arrow length, form, grip, bow weight, draw length, and accessories more critical.

Another arrow rest developed. It became known as a latch or trip type, arrow rest. U.S. Pat. No. 4,344,409 to Barner (1982) discloses the latch type rest. The latch type rest had a wire seat which cocked into support position. It then snapped downward away from arrow when it tripped leaving the arrow in free flight. The bowstring only, is in contact with the arrow. Bowhandle movement does not transfer to the arrow. The movement tripping the latch type rest, is produced by the acceleration of bowstring pressure. The acceleration bowstring pressure pushing the arrow occurs, on the compound bow's power stroke, at the acceleration interval. The acceleration interval is on the front slope of its force-draw curve. The accelerating pressure on the arrow, jerks the bow handle in the direction of the arrow knocking point. The jerk trips the latch. One weakness of the latch type arrow rest is the anchor point. It is almost impossible to anchor at the same point every time under all conditions. If the anchor point is not exactly the same each shot, the arrow speed would be different when it trips. Different speeds would change the direction and stability of the arrow. Other disadvantages of the latch type rest are:

(a) It could trip accidentally when archer gets excited, if jerked in required direction.

(b) The rest needs setting before shooting.

(c) Noise and movement of setting could frighten game.

(d) On a recurve bow the bowstring applies only deceleration pressure on the arrow. Therefore it may not trip until the follow through or some vibration.

(e) They are more expensive to manufacture.

(f) They require a broadhead guard on rest or overdraw.

(g) Repair parts not kept on hand by many archers.

Although this arrow rest removes bowhandle influence on arrow, the arrow will have a different speed on many releases, causing some instability.

Many arrow rests can stabilize an arrow and prevent fletching contact, when the bow handle moves down and forward only. Nevertheless all the launchers and arrow rest previously known have a number of disadvantages. It is quoted in—Bowhunting Yearbook 1990, page 50—"a design engineer for Hoyt, USA, said he used stop-action photography to examine the flight of arrows past arrow rests (all shot with release aid). Regardless of rest style, bow make or arrow style, he could not get the arrow fletching to clear the rest totally".

SUMMARY OF THE INVENTION

This arrow rest extends and pivots from the bowhand side of the arrow. The arrow rest pivots when the arrow accelerating pressure is applied to it. This arrow rest partly removes the arrow contact finger, from the sidewall side of the arrow when it pivots. The bowstring pressure pushing the arrow decelerates after peak bow weight. The bow moves down and in bowhand direction when deceleration starts. The rest moves down and away from arrow. This movement occurs after the compound bows peak weight. It occurs throughout release on a recurve bow. The bowhandle has very little influence on the arrow. The influence is prevented by the movement of the arrow rest and the arrow contact finger removal. The position and movement of arrow rest prevents fletching contact.

ACCORDINGLY OTHER OBJECTS AND ADVANTAGES OF MY INVENTION ARE:

(a) To provide an arrow rest simple to use and inexpensive to manufacture.
(b) To provide knocking point adjustment preventing damage to bowstring.
(c) To provide an arrow rest attached in such a way as to allow the arrow fletching to clear arrow rest.
(d) To provide an arrow rest that pivots from the bow arm side of the arrow.
(e) To provide overdraw models with a super low increase in manufacture cost.
(f) To provide tension adjustments on some models.
(g) To provide simple maintenance.
(h) To provide a support post attached almost directly above the pivot point of bowhandle preventing magnification of movement.
(i) To provide a guard to prevent broadheads from falling out of window.
(j) To provide a system that makes the anchor point elevation less critical. A stable anchor paves the way to using multiple elevation peep sights.
(k) To provide a way to have overdraw and regular receiving slots or threaded apertures on same bracket.
(l) To provide a rest that extends from bow hand side of arrow.
(m) To provide an arrow rest that, when rest moves as little as ⅛" in bow hand direction relative to arrow, the arrow fletching will clear rest completely.

Further objects and advantages are:

Less bowhandle influence on arrow. Less influence make personal tuning, follow through, grip, arrow weight, arrow size, draw length (if short enough), form, practice, sights, and bow less critical. This paves the way for the whole family to use the same bow. The bow could be passed around like a rifle.

DRAWING FIGURES

REFERENCE NUMERALS IN DRAWING

18=arrow rest assembly
20=arrow rest
22=arrow rest support arm
23=threaded aperture for rest
24=securing screw
26=attaching loop
28A=angle bracket
28B=channel bracket
30A=normal position receiving slot
30B=overdraw position slot
32=jam nut
34=washer
36=inside arrow contact point
38=outside arrow contact point
40=bracket attaching holes
42=bowhandle
44=sightwindow shelf
45=bracket attaching screws
46=bowhandle sight window
48=arrow
49=bow hand side of sight window
50=sidewall
52=threaded aperture on bowhandle
54=arrow fletching
56=bowstring
58=knocking ring
60=compound bow
61=force-draw curve
62=handgrip
64A=release position
64B=center of valley
66A=peak weight of bow
66B=peak weight force-draw curve
68A=arrow and string parting point
68B=low point on force-draw curve
70A=acceleration interval
70B=front slope
72A=deceleration interval
72B=back slope
74=longitudinal axis of pressure
76=acceleration force direction
78=deceleration force direction
80=wall
82=cushion plunger
84=bracket attaching slot
94=capscrew
90=threaded aperture for arrow rest support

DESCRIPTION-FIGS. 1 TO 8

Figure 1:
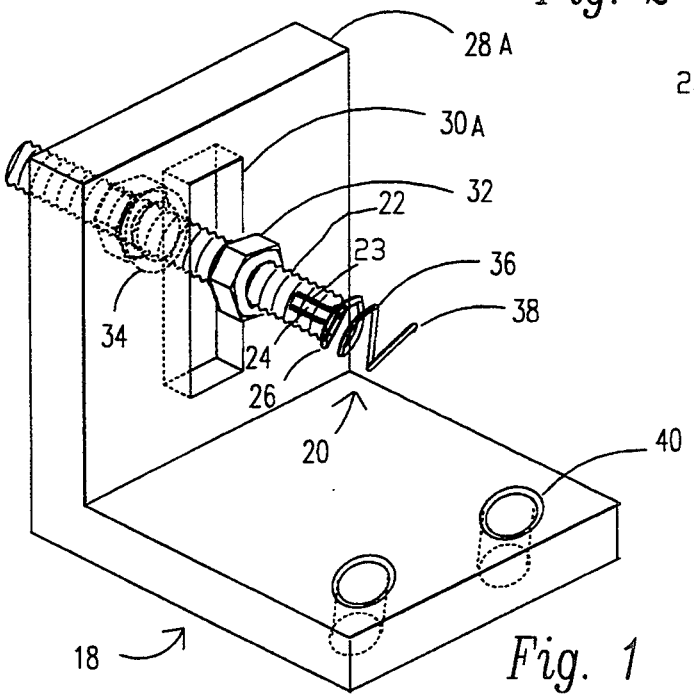
FIG. 1 is a perspective view of this arrow rest in preferred embodiment.

A typical embodiment of the arrow rest assembly 18 of the present invention is illustrated in FIG. 1. The arrow rest 20 is attached to the support arm 22, by threaded aperture 23 and screw 24 through attaching loop 26. The support arm 22 is attached to the bracket 28A at receiving slot 30A using jam nuts 32 and washer 34. The inside arrow receiving point or finger 36 and the outside point or finger 38 form the arrow rest seat. The bracket securing holes 40 are used to secure bracket to bowhandle riser 42 FIG. 2.

Figure 2:
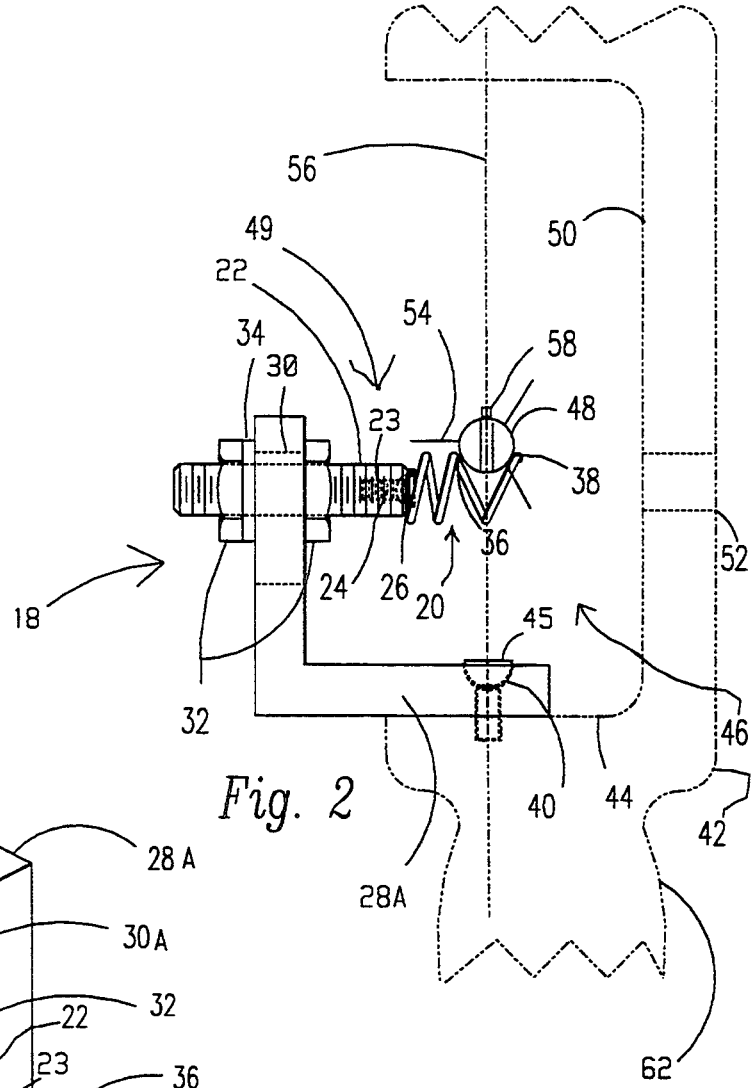
FIG. 2 illustrates a rear elevation view attached to a bow handle riser in phantom.

FIG. 2 shows the arrow rest assembly 18 in the preferred embodiment. It shows a rear elevational view secured to a sightwindow shelf 44 by screws 45. The bracket can be attached by adhesive. The bowhandle 42 is shown in phantom. The rest 20 extends and pivots from the (bow hand side of the sightwindow) 49. It extends from the side of the arrow 48 opposite sidewall 50. The rest 20 is generally positioned opposite the threaded aperture 52. The threaded aperture is used to attach arrow rest and other accessories on modern bows. It shows the arrow 48 with fletching 54 setting on receiving points or fingers 36 and 38. It shows the bowstring 56 inserted in the arrows knock at bowstring's knocking ring 58.

Figure 3A:
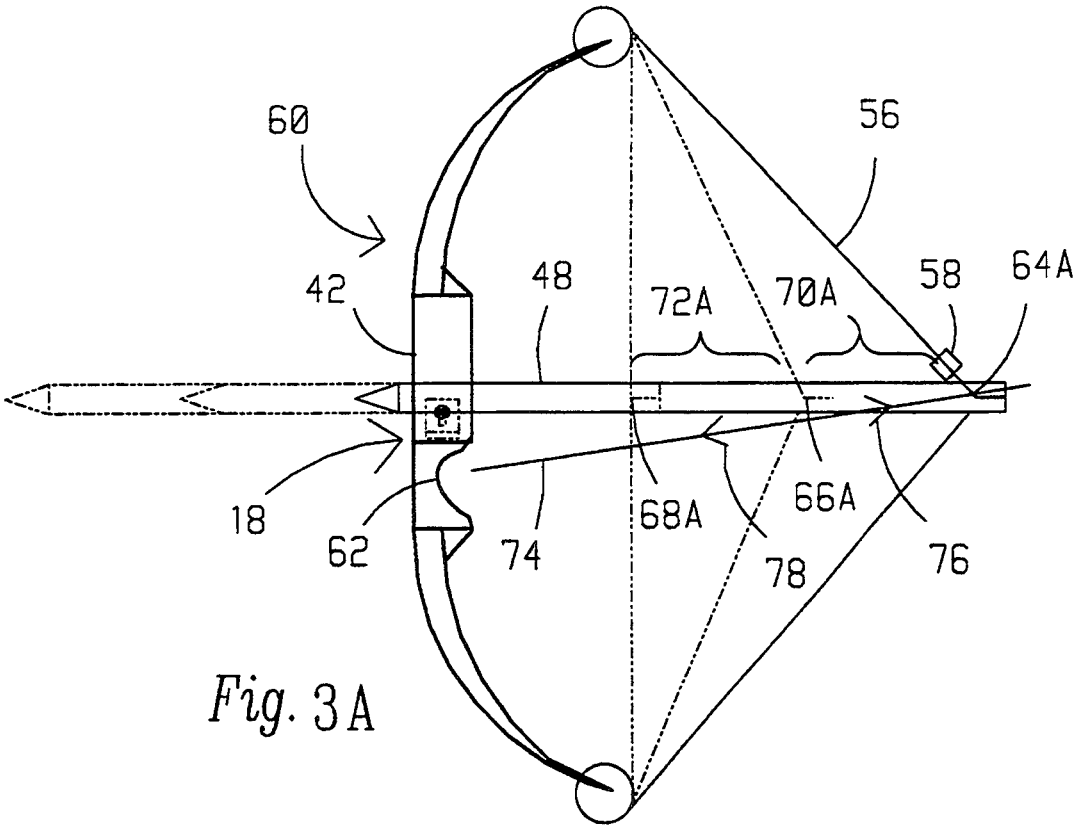
FIG. 3A and 3B illustrates a side elevation of the rest mounted on a compound bow and the coordination between its power stroke and its force-draw curve.
Figure 3B:
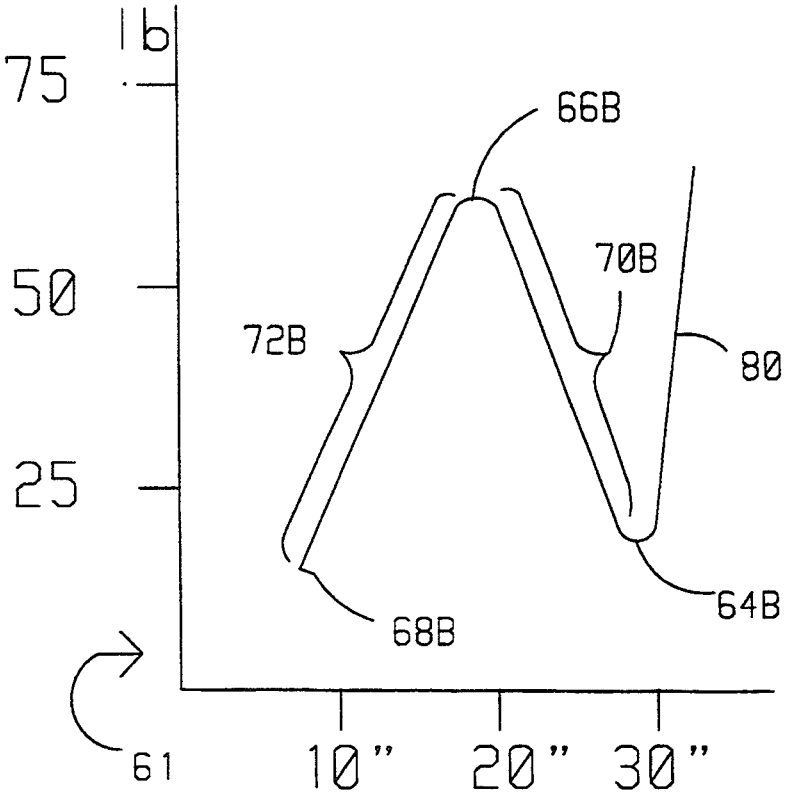

FIG. 3A and 3B illustrates a compound archery bow 60, its power stroke, its force-draw curve 61, and the coordination between the two. FIG. 3A shows a side elevational view of the bow 60. The arrow rest assembly 18 is attached above hand grip 62. It shows the release position 64A on the power stroke. The release position corresponds to the center of the valley 64B on its force-draw curve. It shows the peak bow weight point 66A on the power stroke; this corresponds to the peak weight of the force-draw curve 66B. It shows the arrow and string parting point 68A. The parting point corresponds to the lowest point on the back slope of the force draw curve 68B. It shows the string pressure accelerating interval 70A on the power stroke; this corresponds to the front slope on the force-draw curve 70B. It shows the string decelerating interval 72A on the power stroke; this corresponds to the back slope of the force-draw curve 72B. Line 74 and arrows 76 and 78 illustrate the longitudinal axis and direction of relative pressures on bow 60 at the intervals 70A and 72A.

Figure 4:
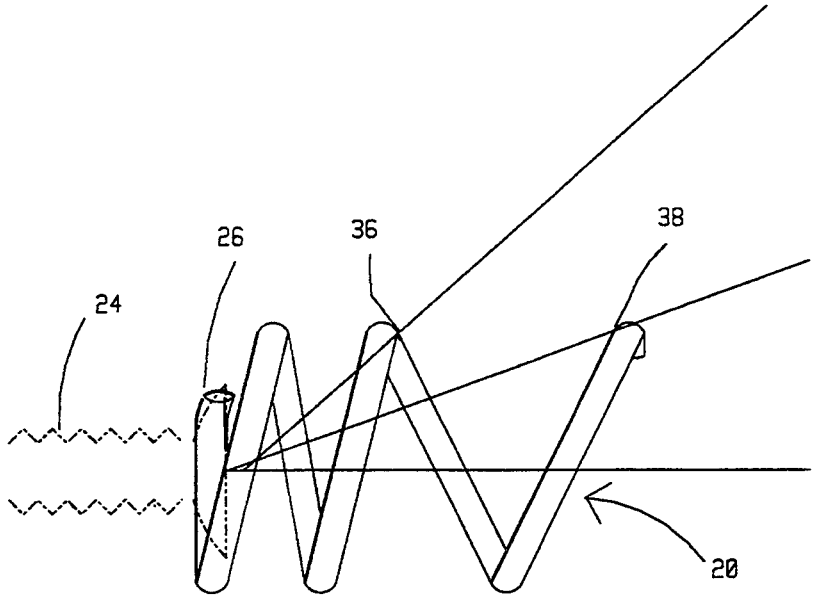
FIG. 4 illustrates the arrow rest pivot point, the arrow contact points; plus the different angles and distances of the arrow contact points from the pivot point.

It is illustrated in FIG. 4 the arrow rest 20, the attaching loop 26 and arrow contact points or fingers 36 and 38. FIG. 4 illustrates the inside arrow contact finger 36 and the outside arrow contact finger 38. They have a different angle and a different distance from the pivot point or attaching loop 26.

Figure 5A:
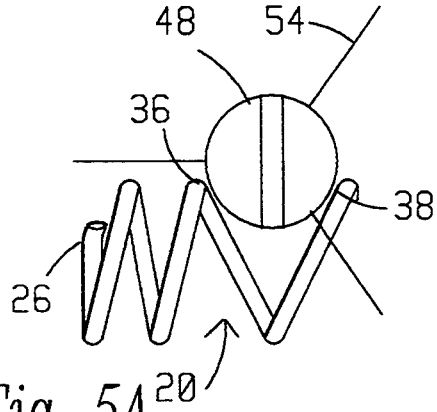
FIGS. 5A to 5C illustrates different positions of the arrow rest and arrow with fletching, as arrow moves through the power stroke.
Figure 5B:
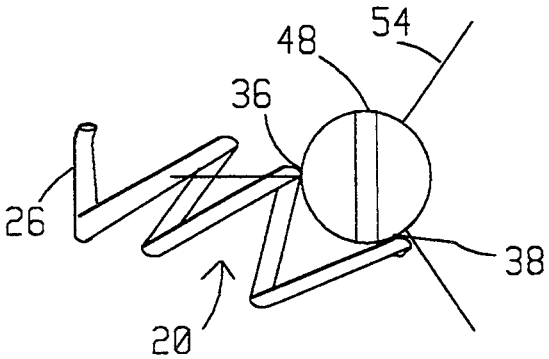
Figure 5C:
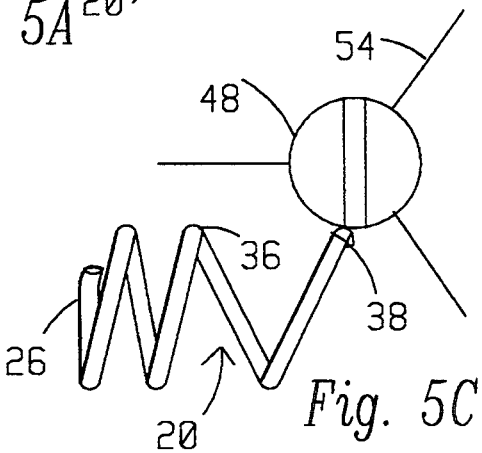

FIG. 5A to 5C illustrates different positions of arrow rest arm 20, arrow contact points 36 and 38. They show the position of arrow 48 with fletching 54, during release. FIG. 5A shows the arrow rest 20 at release position 64A FIG. 3. FIG. 5B illustrates the deflection of the arrow rest arm 20. 5C shows the arrow rest at arrow and string parting point FIG. 3. FIG. 5C shows the arrow rest arm 20 returned to normal with some lateral and downward displacement in the direction of bowhand.

Figure 6:
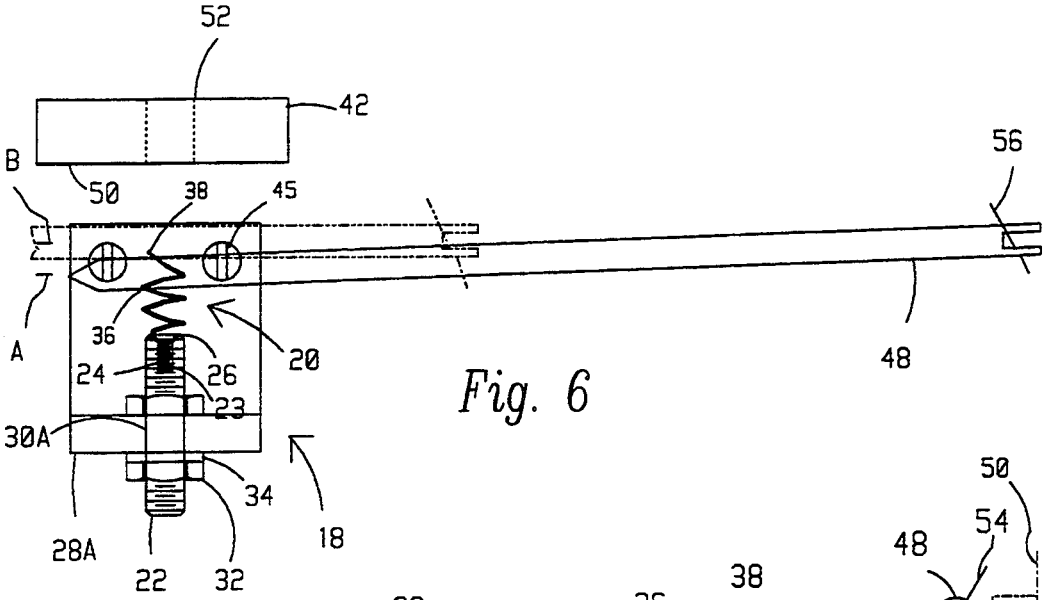
FIG. 6 illustrates a top view of the arrow rest with an arrow; it shows the bowhandle movement relative to arrow during the last portion of a release.
Figure 7A:
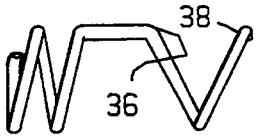
FIGS. 7A to 7D illustrate different ramifications of arrow rest that may be used with this arrow rest assembly.
Figure 7B:
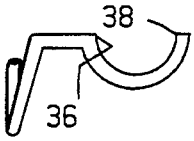
Figure 7C:
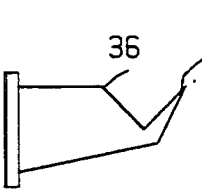
Figure 7D:
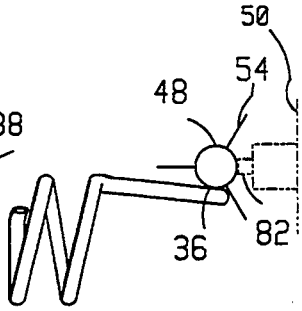

FIG. 6 illustrates a top view of the arrow rest 20. Arrow position A shows the arrow 48 on the rest at release 64A FIG. 3. The phantom arrow position B, shows the arrow position relative to bowhandle, at arrow and bowstring parting point 68A FIG. 3. The distance between A and B, represents the effective displacement of the bow handle 42 FIG. 6. The displacement is in the direction of bow hand. The distance between A and B is determined by the lateral setting of arrow rest when the bow is tuned.

FIG. 7 illustrates ramifications of arrow rest arms. FIG. 7A is a flipper type rest made of wire spring with a generally V-shape notch for the arrow. FIG. 7B is a flipper type rest made of springy wire with a U-shape notch. FIG. 7C is a plastic flipper with a notch to hold arrow. FIG. 7D is a spring with a straight flipper that angles to hold the arrow against a cushion plunger 82.

Figure 8A:
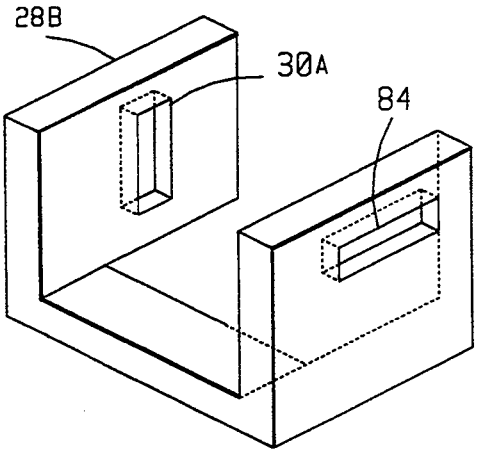
FIGS. 8A to 8H illustrate different ramifications of brackets that may be used by this arrow rest assembly.
Figure 8B:
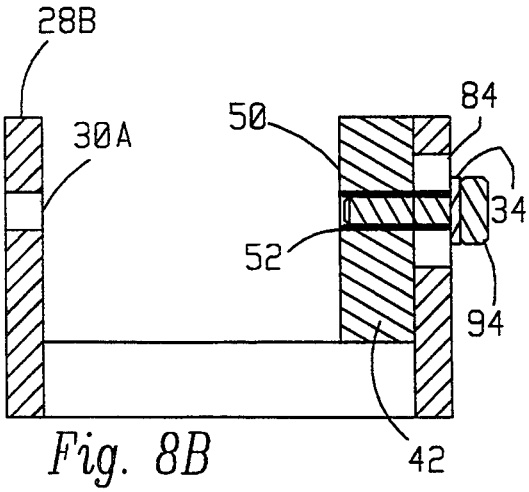
Figure 8C:
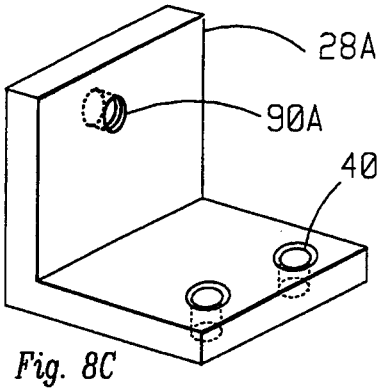
Figure 8D:
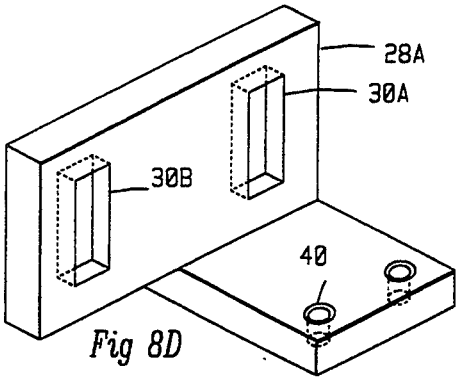
Figure 8E:
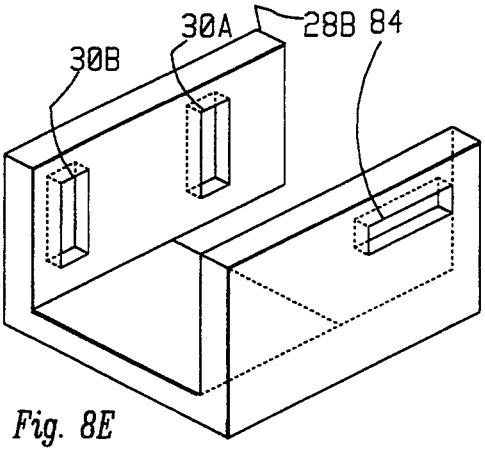
Figure 8F:
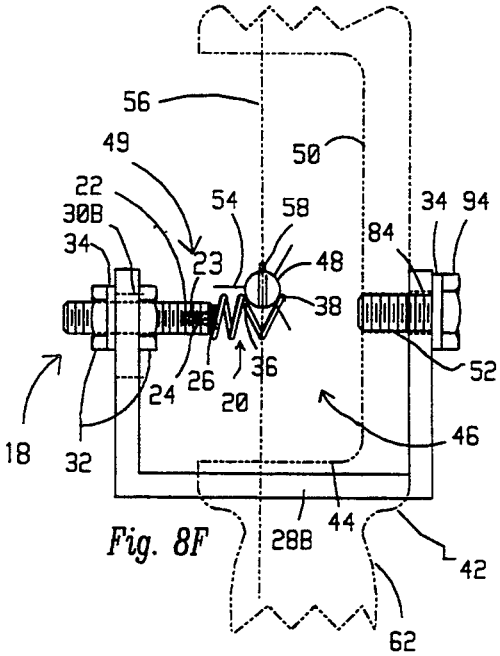
Figure 8G:
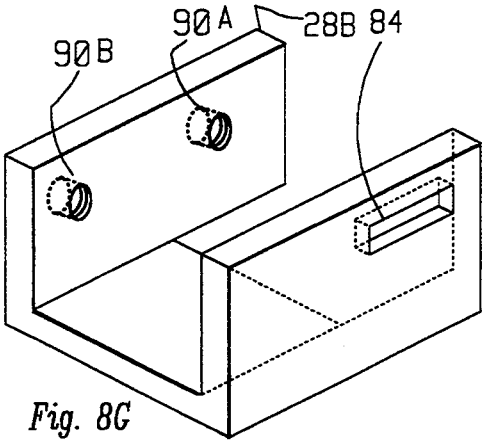
Figure 8H:
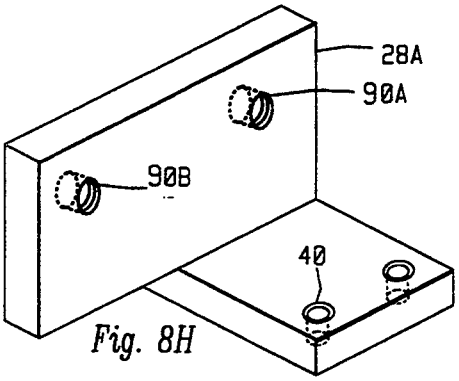

FIG. 8A to 8F illustrates ramifications of brackets. FIG. 8A illustrates a channel bracket 28B with slot 84 to attach to the threaded aperture 52. Modern recurve and compound bows have a threaded aperture on bowhandles. Fig. 8B is a sectional view of FIG. 8A. It illustrates how the bracket is attached to a bowhandle. FIG. 8C illustrates a threaded aperture 90A used for installing the arrow rest support 22. FIG. 8D illustrates a receiving slot 30B to the rear of the regular slot to use with shorter arrows. FIG. 8E illustrates a channel bracket 28B with overdraw slot 30B and regular slot 30A. FIG. 8F illustrates the channel type bracket 28B attached to the threaded aperture 52 on the bowhandle 42. Fig. 8G illustrates the channel bracket 28B with threaded apertures 90A and 90B. FIG. 8H illustrates the angel bracket 28A with threaded apertures 90A and 90B.

OPERATION-FIGS. 2,3,5,6

Shooting the compound bow 60 FIG. 3 an archer knocks an arrow 48 on the bow string 56 at knocking ring 58. The archer sets the arrow 48 on the arrow contact points 36 and 38 of the arrow rest 20 FIG. 2. The bow 60 FIG. 3 is held away from the archer's body with one hand. The bow 60 is held by the grip 62 on the bowhandle. The bowstring 56 is pulled with the other hand through the draw stroke. The string 56 is pulled to the release position 64A FIG. 3 (the end of mechanical advantage). (The release position 64A corresponds to the center of the valley 64B on the compound bows force-draw curve 61. The valley 64B is maximum weight reduction on the force-draw curve 61. The weight will increase fast or hit the so called wall if the string is drawn past the valley 64B.)

The bow is aimed at target and the bowstring 56 is released while the sights are held on target. The bowstring 56 moves through the power stroke pushing the arrow 56, after release. The compound bow reacts to the pressures in the force-draw curve, on the power stroke. Between release point 64A and peak bow weight 66A FIG. 3 is the acceleration interval 70A. The bowstring 56 pressure pushing the arrow 48 is accelerating. ( The bow weight accelerates on the front slope 70B of its force-draw curve.) The bowhandle 42 pressure on the bow arm is accelerating. The direction of pressure is from grip 62 toward the arrow knocking point 58. The pressure produces bowhandle movement. The movement is in the direction of arrow 76. It is on the longitudinal axis between grip 62 and knocking ring 58. The bowhandle 42 movement in the direction of the arrow's knocking ring 58 trips some arrow rests. U.S. Pat. No. 4,344,409 to Barner (1982) is an example of the trip or latch type, arrow rest.

Between peak bow weight 66A and arrow and string parting point 68A is the deceleration interval 72A. (The bow weight is decelerating on the back slope 72B of its force-draw curve.) The bowstring 56 pressure pushing the arrow 48 decelerate on the deceleration interval 72A until the arrow leaves the string 56. The bowstring's decelerating pressure pushing the arrow 48, allows the bowhandle grip section 62 with tension from bow hand to move forward. The relative bowhandle 42 pressure is from knocking point 58 toward the bowhandle grip 62. The direction and longitudinal axis are indicated by arrow 78 and line 74. The forward movement is opposite of when bowstring 56 pressure pushing the arrow 48 was accelerating. The bow hand is holding the bowhandle 42 loosely. The bowhandle 42 will have a tendency to follow the still attached bow hand when it moves forward. The bow hand is attached to the archer's body. The bow hand will have a tendency, to circle the archer's body when moving forward. The bowhandle also moves down during release for two reasons. The first reason is due to gravity. The second is due to the longitudinal axis angle indicated by line 74. It is the angle between the arrow knocking point 58 and bowhand grip 62. The above movements can be dampened by accessories and technique, but not stopped.

FIG. 5A illustrates the arrow rest 20 and arrow 48 with fletching 54 at the release point 64A FIG. 3.

FIG. 5B illustrates the arrow rest 20 deflected. The deflection is caused by the accelerating pressure from the arrow 48 and the bowhandle movement in the direction of knocking ring 58 on the string 56. The accelerating pressure on the arrow 48 causes the bowhandle 42 movement. The acceleration pressure takes place between the release position 64A and peak bow weight 66A FIG. 3. The movement is what trips the latch type arrow rest. U.S. Pat. No. 4,344,409 to Barner (1982) is an example of the trip or latch type, arrow rest. The inside point 36 is on the (bowarm side of the arrow) 49. It shows how the deflection partly removes the outside arrow contact point 38 from the arrow's (sidewall side) 50. The removal of arrow contact point 38 is the result of the position of the arrow rest and, the different angle and distance the points are from pivot point.

FIG. 5C illustrates the arrow rest 20 at the bowstring and arrow parting point 68A FIG. 3. It shows the arrow rest 20 returned to normal with some descending and lateral displacement. This displacement takes place between peak bow weight 66A and arrow and string parting parting point 68A. There are two reasons for the displacement. The first is the decelerating bowstring 56 pressure on the arrow 48. The second is the longitudinal axis angle between the knocking ring 58 and the grip 62. The decelerating pressure on arrow 48 releases pressure on the bowhand and allows it to move forward. It moves along the longitudinal axis 74 from knocking ring 58 toward bowhandle grip 62. The movement is in the opposite direction of the one that trips the latch type rest. The reason for some lateral movement is that the bowhand is attached to the archer's body and will have a tendency to circle it as it moves forward.

FIG. 6 shows a top view of the present invention, the arrow 48 on arrow rest 20 at release position 64A FIG. 3. It also shows with the phantom arrow the relative arrow position to bow handle when arrow 48 and bow string 56 parts. The distance between point A and B after the bow is tuned will be the effective bowhandle movement. The bowhandle moves toward bowhand; this occurs during last half of release. The movement toward bowhand will be between peak bow weight 66A and bowstring and arrow parting point 68A. The vertical adjustment of arrow knocking point and the lateral adjustment of arrow rest is called tuning. The bow is adjusted until the arrow leaves the bow with the arrow knock end tracking the arrowhead. Use the paper test or bare shaft test to tune bow. Some slow bows may need a knock high setting to shoot properly.

SUMMARY, RAMIFICATIONS, AND SCOPE

Accordingly, the user will see that my arrow rest is simple to use and understand. It is easy to install and tune. The support post, jam nuts, and arrow rest installation screws are in most archer's inventories. It is easy to monitor for movement or damage. It is inexpensive. It is installed extending generally laterally from the bow hand side of bow. The installation and pivoting from the bowhand side stops arrow fletching contact with the arrow rest. It is almost impossible to have fletching contact. If it is accidentally bent it may be straightened by hand. The bow handle has less influence on arrow. Personal form, habits, grip, follow through, arrow weight and arrow length, are not as critical. Therefore, different people can often shoot the same bow well. Using this rest a bow seems to have about the same requirements as a rifle. The archer holds the sights on target with complete attention, until the release.

The descriptions above contain many specificities. These should not limit the scope of the invention, but merely provide illustrations of some of the presently preferred embodiments of this invention. For example, the arrow rest contact points can have other shapes. The rest may be a spring, plastic or wire flipper. The flipper rest can hold the arrow against a cushion plunger. Its requirement is to pivot from the bowarm side of the arrow. Resistance is removed from the sidewall side of the arrow. It helps stop possible fletching contact. The scope of the invention should be determined by the appended claims and their legal equivalents, rather than by the examples given.

I claim:

1. An adjustable arrow rest assembly for an arrow being shot from an archery bow by an archer, while holding said bow up with a bowarm, said archery bow having a handle including a sidewall and a shelf, a bowstring, and a set of limbs, said adjustable arrow rest assembly comprising:

a mounting base; an arrow rest support;

a single pivotally attached resilient arrow rest arm spaced from and extending laterally toward said sidewall, having on one end spaced arrow receiving point portions, said arrow receiving point portions being located to receive and support said arrow on said bowhandle in position for shooting, and a means for attaching said arm to said arrow rest support, a means to attach said arrow rest support to said mounting base, means attaching said mounting base to said bowhandle at a preselected location; whereby upon release of the bowstring, said arrow rest arm will move away from said arrow.

2. The arrow rest assembly of claim 1 wherein said mounting base comprises a rigid bracket adapted to be secured to said archery bow, said bracket has a planer surface with a receiving slot sized to receive and adjust said arrow rest support therein.

3. The arrow rest assembly of claim 2 wherein said bracket is extended in the direction of said bowstring, to provide said receiving slot between said bowhandle and said bowstring, to be used when using shorter arrows.

4. The arrow rest assembly of claim 2 wherein said arrow rest support is a shaft threaded to receive jam nuts for adjusting radial and lateral position by radial and axial movement of said shaft and locking said shaft in place, said shaft has a threaded recess at one end to receive said arrow rest arm.

5. The arrow rest assembly of claim 2 wherein said bracket is shaped to be attached to said bowhandle at a threaded aperture supplied on all modern bows.

6. The arrow rest assembly of claim 2 wherein said slot may be of any length.

7. The arrow rest assembly of claim 1 wherein said single pivotally attached resilient arrow rest arm is a coil spring, said coil spring has a smaller turned coil on one end for attaching to said arrow rest support.

8. An adjustable arrow rest assembly for an arrow being shot from an archery bow by an archer while holding said bow up with a bowarm, said archery bow having a handle including a sidewall and shelf, a bowstring, and a set of limbs, said adjustable arrow rest assembly comprising:

a mounting base; an arrow rest support;

a pivotally attached resilient arrow rest arm, having on one end two arrow receiving point portions, located to receive and support said arrow on said bowhandle in position for shooting and a means for attaching said arm to said arrow rest support, a means to attach said arrow rest support to said mounting base, a means to attach said mounting base to said bowhandle at a preselected location; the improvements wherein said arrow rest arm having said two arrow receiving point portions is spaced from and extending laterally towards said sidewall, whereby a bowhandle and arrow rest arm movement, produced by pressures on said bowhandle and said arrow during release, helps separate said arrow from said arrow rest.

9. The arrow rest assembly of claim 8 wherein said mounting base comprises:

a ridged bracket adapted to be secured to said bowhandle, with a capscrew through an adjusting slot in said bracket to the threaded aperture supplied on most modern bows; said bracket has a planer surface with a threaded aperture sized to receive said arrow rest support.

10. The arrow rest assembly of claim 9 wherein said bracket is extended in the direction of said bowstring to provide said threaded aperture between said bowhandle and said bowstring, to be used with shorter arrows.

11. The arrow rest assembly of claim 8 wherein said arrow rest support is a shaft threaded to provide means of radial and lateral adjustment by radial and axial movement of said support; said shaft has jam nuts as a locking means, and a threaded recess on one end to secure said arrow rest arm.

12. The arrow rest assembly of claim 8 wherein said arrow rest arm is a flipper arm type made of a resilient material with said arrow receiving points.

13. The arrow rest assembly of claim 12 wherein said flipper arm extends from a coil spring.

14. The arrow rest assembly of claim 12 wherein said both arrow receiving point portions pivot from the side of said arrow nearest said bow arm.

15. An adjustable arrow rest assembly for an arrow being shot from an archery bow by an archer, while holding said bow up with a bowarm, said archery bow having a handle including a sidewall and a shelf, a bowstring, and a set of limbs, said adjustable arrow rest assembly comprising:

a mounting base; an arrow rest support;

a pivotally attached resilient arrow rest arm, spaced from and extending laterally toward said sidewall, having on one end spaced arrow receiving point portions, said arrow receiving point portions being located to receive and support said arrow on said bowhandle in position for shooting, and a means for attaching said arm to said arrow rest support, a means to attach said arrow rest support to said mounting base, means attaching said mounting base to said bowhandle at a preselected location; whereby upon release of the bowstring, said arrow rest arm will move away from the arrow.

16. The rest assembly of claim 15 wherein said mounting base is a bracket with a planer surface with a means to receive and adjust said arrow rest support.

17. The arrow rest assembly of claim 16 wherein said arrow rest support has a means to receive said arrow rest arm.

18. The arrow rest assembly of claim 15 wherein said arrow rest arm is made of flexible material with two arrow receiving point portions.

19. The arrow rest assembly of claim 18 wherein said two receiving point portions are attached to an arm extending from the side of said arrow nearest said bowarm.

20. The arrow rest assembly of claim 15 wherein said arrow rest arm provides a pivotal hinged arrow rest extending from the side of said bow nearest said bowarm.

* * * * *